United States Patent [19]

Sole-Leris

[11] Patent Number: 4,625,367

[45] Date of Patent: Dec. 2, 1986

[54] RIGID CLOTHING FOR CARD FLATS

[76] Inventor: Roger Sole-Leris, Provenza, 276, 08008 Barcelona, Spain

[21] Appl. No.: 786,304

[22] Filed: Oct. 10, 1985

[30] Foreign Application Priority Data

Oct. 11, 1984 [ES] Spain ..... 288.973[U]

[51] Int. Cl.[4] ..... D01G 15/84

[52] U.S. Cl. ..... 10/113

[58] Field of Search ..... 19/113, 114

[56] References Cited

U.S. PATENT DOCUMENTS 2,937,413 5/1960 Hollingsworth ..... 19/114

4,090,276 5/1978 Roberts ..... 19/114 X 4,398,318 8/1983 Ashworth ..... 19/114

*Primary Examiner*—Louis K. Rimrodt

*Attorney, Agent, or Firm*—Wenderoth, Lind & Ponack

[57] ABSTRACT

The rigid clothing comprises a plurality of juxtaposed metallic strips, each comprising a base for fixing it to the flat and a row of spikes which act on the fibers, the spikes having two effective surfaces, a first active front surface for orientating and combing the fibers and a second active rear surface for holding the fibers. The two effective surfaces are on the same respective spike of a strip and all spikes on the strip are identical in shape.

6 Claims, 9 Drawing Figures

RIGID CLOTHING FOR CARD FLATS

FIELD OF THE INVENTION

The present invention relates to rigid clothing for card flats.

BACKGROUND OF THE INVENTION

Flexible clothing for card flats having an inclined L-shaped effective configuration are very well known in the textile industry. Said flexible clothing is used, in particular for cotton and has the function of orientating the long and short cotton fibers and extracting the impurities from the cotton.

Similarly, rigid clothing consisting of toothed metal strips comprising an insertable complementary lower base is also known and can be used for synthetic fibers and has the function of orientating said fibers.

Both types of known clothing have disadvantages, as the flexible clothing wears away to a great extent and the rigid clothing is not suitable for cotton as it does not extract the impurities from it.

SUMMARY OF THE INVENTION

The above-mentioned disadvantages have been overcome by means of the present invention which provides an improved rigid clothing which can be used for cotton fibers and synthetic fibers and which also allows the impurities to be removed from cotton.

According to the present invention, the spikes on the strip have two effective surfaces, an active front surface for orientating and combing the fibers and a rear surface for holding the short fibers, these surfaces forming an angle between one another. The front surface is preferably positioned at the top of a spike and the rear surface is preferably positioned at the bottom of a spike.

According to an object of the present invention, said two effective surfaces can be provided on a single strip of the clothing on the same spike or on a different spike of the strip.

According to a further object of the present invention, each effective surface can be provided on a respective strip, in which case the clothing is constituted by pairs of laterally juxtaposed strips, each strip incorporating a type of surface.

DETAILED DESCRIPTION

Figure 1:
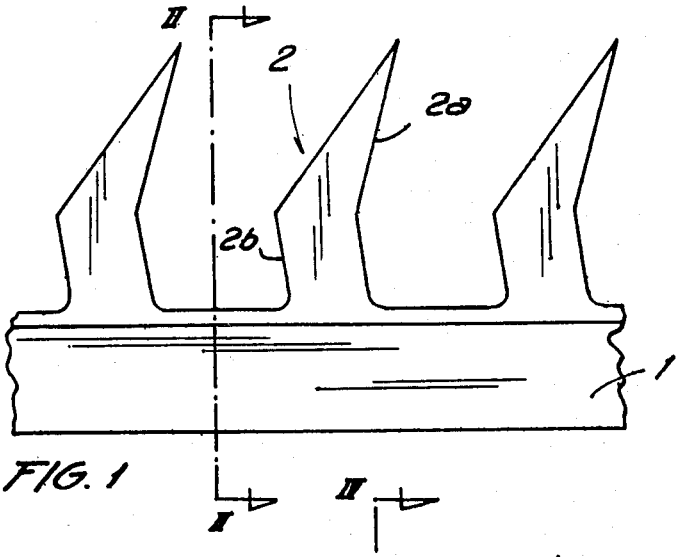
FIG. 1 shows an elevation of a portion of a clothing strip according to the present invention in which each spike incorporates both types of effective surface.
Figure 2:
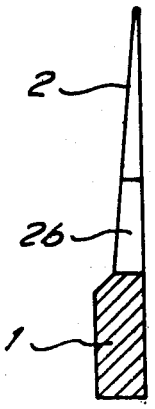
FIG. 2 corresponds to a sectional view through the plane II—II of the strip in FIG. 1.

As shown in FIGS. 1 and 2, the rigid clothing for card flats according to the present invention is based merely on metal strips 1 of which each strip comprises a base which extends in a longitudinal direction for fixing the strip to a flat, each strip having a plurality of successively arranged identically shaped spikes 2 separated by gullets, each spike incorporating two types of effective surfaces which form an obtuse angle between one another, a leading active front upper edge or surface 2*a* which orientates and combs the fibers and a trailing lower rear edge or surface 2*b* for holding the short fibers. As can be seen in FIG. 1, the lower front and rear edges of each spike are nearly parallel whle the upper front and rear edges converge to a pointed tip which faces towards the leading direction of the strip. Each spike has a lower holding portion between the lower front and rear edges and an active portion between the upper front and rear edges, the space between the holding portions of two successive holding short fibers and impurities. The leading edge of each spike comprises an active upper part 2*a* and an inactive lower part which form an obtuse angle with each other. Likewise, the trailing edge comprises an active lower part 2*b* and an inactive upper part which form an obtuse angle with each other. Each spike is separated by a gullet having the shape of a parallelogram between the holding portions of each spike, i.e. between the active lower part of a trailing edge of one spike and the inactive lower part of the leading edge of the next successive spike. As can be seen in FIG. 1, the base portion of the gullet extends substantially parallel to the longitudinal direction of the base.

Figure 3:
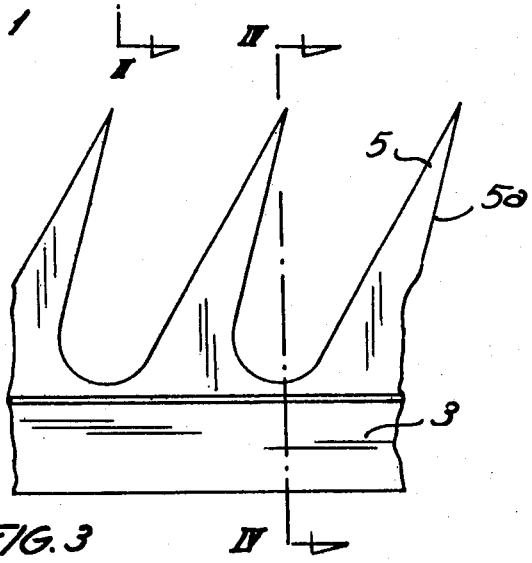
FIG. 3 shows a further elevation of a portion of a clothing strip according to the present invention in which each spike incorporates a first type of effective surface.
Figure 4:
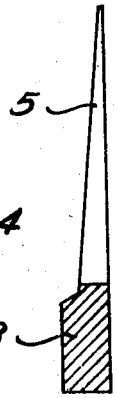
FIG. 4 shows a sectional view through the plane IV—IV of the strip in FIG. 3.
Figure 5:
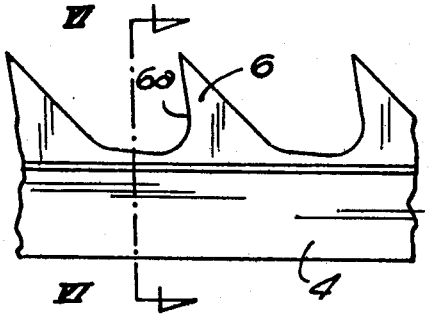
FIG. 5 is a further elevation of a portion of a clothing strip according to the present invention in which each spike incorporates a second type of effective surface.
Figure 6:
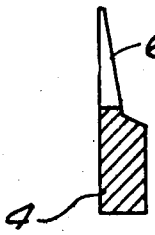
FIG. 6 corresponds to a sectional view along the line VI—VI of the strip in FIG. 5.
Figure 7:
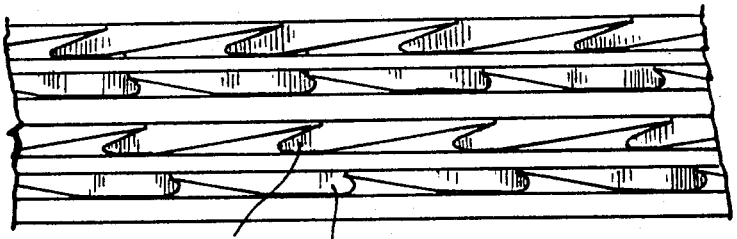
FIG. 7 is a plan view of a portion of clothing according to the present invention.
Figure 8:
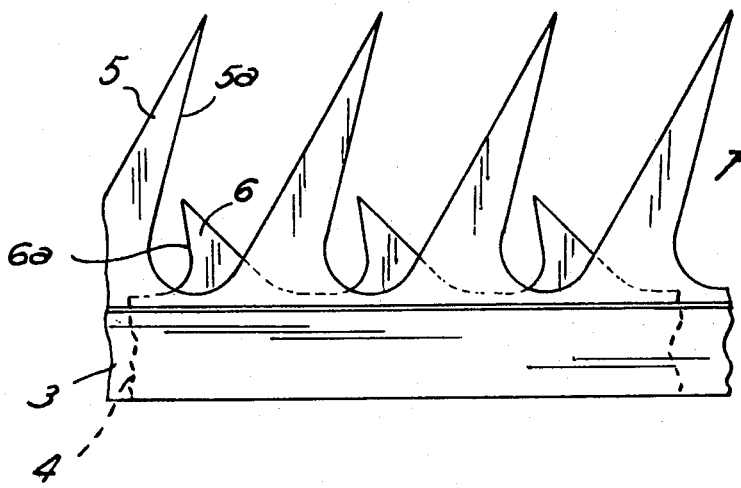
FIG. 8 shows an elevation of two strips like those shown in FIGS. 3 and 5 arranged in a juxtaposed position so as to constitute the portion of clothing illustrated in FIG. 7.

According to the invention, said clothing can also be formed by combining two strips 3 and 4 (as shown in FIGS. 3 and 5). The first 3 of said strips comprises a row of spikes 5 which incorporate the active front upper effective surface 5*a* while the second strip 4 comprises a row of spikes 6 with the lower rear effective surface 6*a* for holding the fibers. Said strips 3 and 4 are juxtaposed laterally in pairs resulting in the portion of clothing shown in a respective plan view and elevation in FIG. 8 in which the effective surfaces 5*a* and 6*a* of the juxtaposed strips 3 and 4 form an angle between one another and are positioned transversely to a flat. FIG. 7 shows a plan view of a portion of clothing constituted by pairs of strips 3 and 4 which are juxtaposed in the manner indicated.

Figure 9:
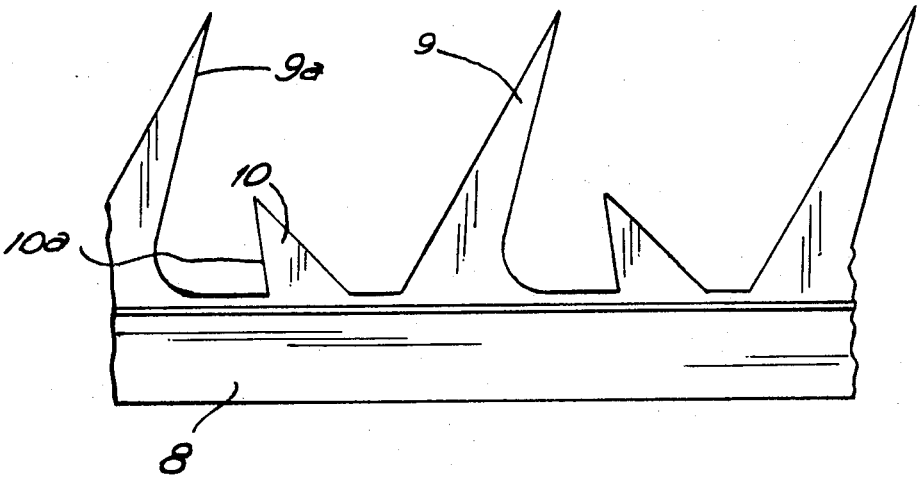
FIG. 9 shows a further elevation of a portion of a clothing strip according to the present invention in which each alternate spike comprises a respective type of effective surface.

Similarly, according to the present invention, the effective active and holding surfaces can be provided, on respective alternating spikes on the same strip 1, as shown on the strip 8 illustrated in FIG. 9, in which some spikes 9 have the active front upper effective surface 9*a* and other alternate spikes 10 have the lower rear surface 10*a* for holding, said surfaces 9*a* and 10*a* forming an angle between one another. The longitudinal separation or spacing between the high spikes 9 and the low spikes 10 in the general direction of the rigid clothing, can be any suitable dimension.

The present invention proposes that the front and rear effective surfaces of the spikes occupy the entire front or rear edge of the spike or the upper or lower portion of said edge. Similarly, said edge may or may not be straight.

What is claimed is:

1. Rigid clothing for card flats comprising a plurality of juxtaposed metal strips positioned on a flat, each of said metal strips having a base which extends in a longitudinal direction and which is secured to the flat and each of said metal strips having a row of spikes separated by gullets, each of said spikes comprising a front leading edge and a rear trailing edge, said front leading edge having an active upper part terminating in a pointed tip for orientating and combing fibers and said rear trailing edge having an active lower part terminating at said base for retaining short fibers and impurities in a lower portion of a gullet between said active part of said rear trailing edge and a lower part of a front leading edge of a following spike.

2. Rigid clothing according to claim 1, wherein said leading edge comprises said active upper part and an inactive lower part which form an obtuse angle with each other, said trailing edge comprises said active lower part and an inactive upper part which form an obtuse angle with each other, said active lower part of said trailing edge and said inactive lower part of said leading edge being nearly parallel to each other and inclined in a direction facing the trailing direction of said row of spikes and said active upper part of said leading edge and said inactive upper part of said trailing edge forming said pointed tip, said pointed tip facing the leading direction of said row of spikes.

3. Rigid clothing according to claim 1, wherein all of said spikes on said plurality of metal strips are identical in shape.

4. Rigid clothing according to claim 1, wherein said gullet is shaped with a base portion of said gullet extending substantially parallel to said longitudinal direction of said base.

5. Rigid clothing according to claim 1, wherein said gullet has a shape of a parallelogram between said active lower part of a trailing edge of a spike and said lower part of a leading edge of a following spike.

6. Rigid clothing for card flats comprising a plurality of juxtaposed metal strips positioned on a flat, each of said metal strips having a base which extends in a longitudinal direction and which is secured to the flat and each of said metal strips having a row of spikes separated by gullets, each of said spikes comprising a front leading edge and a rear trailing edge, said front leading edge having an active upper part terminating in a pointed tip for orientating and combing fibers and said rear trailing edge having an active lower part terminating at said base for retaining short fibers and impurities in a lower portion of a gullet between said active part of said rear trailing edge and a lower part of a front leading edge of a following spike, said leading edge comprising said active upper part and an inactive lower part which form an obtuse angle with each other, said trailing edge comprising said active lower part and an inactive upper part which form an obtuse angle with each other, said active lower part of said trailing edge and said inactive lower part of said leading edge being nearly parallel to each other and inclined in a direction facing the trailing direction of said row of spikes and said active upper part of said leading edge and said inactive upper part of said trailing edge forming said pointed tip, said pointed tip facing the leading direction of said row of spikes, said gullet being shaped with a base portion of said gullet extending substantially parallel to said longitudinal direction of said base and said gullet having a shape of a parallelogram between said active lower part of a trailing edge of a spike and said lower part of a leading edge of a following spike.

* * * * *